United States Patent [19]

Wallis

[11] Patent Number: 4,625,407

[45] Date of Patent: Dec. 2, 1986

[54] LENGTH-MEASURING ATTACHMENT FOR CHAIN SAW

[76] Inventor: F. Patrick Wallis, 17717 Scott La., Gladstone, Oreg. 97027

[21] Appl. No.: 764,589

[22] Filed: Aug. 12, 1985

[51] Int. Cl.[4] ..... B27B 17/00

[52] U.S. Cl. ..... 30/383

[58] Field of Search ..... 30/381–387

[56] References Cited

U.S. PATENT DOCUMENTS 4,341,018 7/1982 Nelson et al. ..... 30/383

4,377,910 3/1983 Landry ..... 30/383

4,545,122 10/1985 Durfee ..... 30/383

*Primary Examiner*—Douglas D. Watts

*Attorney, Agent, or Firm*—Chernoff, Vilhauer, McClung & Stenzel

[57] ABSTRACT

A length-measuring attachment for a chain saw includes a clamp assembly for mounting a transversely-extending measuring arm to the chain saw handle. A slidably mounted resilient index pointer is connected to the arm for marking the appropriate length of a piece of wood to be cut. The resilient pointer flexes enabling cuts to be made at any point along the piece of wood and serves to indicate proper plane of cut as well as proper length.

3 Claims, 3 Drawing Figures

LENGTH-MEASURING ATTACHMENT FOR CHAIN SAW

BACKGROUND OF THE INVENTION

The following invention relates to an attachment for a chain saw for measuring the length of a piece of wood to be cut.

Chain saws are frequently used to cut a single log or length of wood into a number of predetermined lengths for easier handling or to be used as firewood. When cutting firewood it is sometimes necessary to measure the log within tolerances of an inch. For example, some stoves require 18 inch length firewood while others will accommodate wood having a length of 20 inches or more. Especially when cutting firewood it is important that the cut be made perpendicular to the axis of the log. This is so that the cut pieces may be stood on their ends upright for splitting. If the log is cut at an angle the cut piece will have to be propped up in some complicated fashion to enable it to be split.

In the past various length measuring devices for measuring a cut of wood have been available for use as either integral parts of or attachments to a chain saw. For example in Nelson, U.S. Pat. No. 4,341,018 an angled rod is used as a log gauge. The log gauge of Nelson may be adjusted by sliding it through an attaching piece which clamps the guide to the handle. However, beyond a three- or four-inch adjustment the rod would be completely separated from the attachment or would run into the guide bar or the housing of the saw itself. Another problem with the Nelson device is that it is not easily disassembled, and the guide bar, being an angled bar, is an awkward shape for carrying through the difficult terrain sometimes encountered by loggers.

Another type of measuring instrument is shown in U.S. patents to Chontos, U.S. Pat. No. 4,275,504, and Johansson, U.S. Pat. No. 3,276,490. Both of these patents disclose chain saw attachments which employ an extendable metal tape which may either be fastened to the end of a log or one which rigidly extends to the side having index markings for establishing the proper length to be cut. Both the Johansson and the Chontos devices, however, suffer from the problem that they are not easily detached from the chain saw but must be rigidly attached to the saw housing by screws or nuts and bolts. They are thus not suitable for use as retrofit attachments which may be sold and placed on an existing chain saw. Moreover, these devices provide only a linear measurement of length and provide no help in determining if the cut is perpendicular to the grain of the wood. Both also involve complicated mechanisms which involve a coiled metal tape which is spring loaded which could be subject to jamming if the mechanism became rusty or was dropped in sand or dirt.

Yet another type of measuring gauge uses a telescoping rod which is fastened in some manner to the chain saw housing. Two such devices are shown in Hinrichs, U.S. Pat. No. 4,233,739, and Romancky, U.S. Pat. No. 3,531,670. Both of these devices are simply linear guides for marking a length of wood and provide no means for insuring that the cuts are parallel. Both also require complicated fastening means to attach them to the chain saw housing and are thus not suitable for use as a retrofit attachment which may be easily attached to or detached from an existing chain saw.

Yet another type of measuring device is shown in Debell, U.S. Pat. No. 4,388,762. The Debell device is a relatively complicated mechanism, which in order for it to be attached to a chain saw, assumes the presence of a pair of threaded chain bar mounting studs located at a convenient position.

Thus, all of the above chain saw length measuring attachments suffer from one or more deficiencies such as ease of attachment, simplicity of operation, and accuracy of the cut. What is needed, therefore, is a length measuring attachment for a chain saw which may be easily attached to and disassembled from the chain saw, is inexpensive, rugged and yet provides the accuracy necessary to insure that the cut is made at both the proper length and the proper plane.

SUMMARY OF THE INVENTION

The present invention provides a length measuring attachment which may be easily attached to a chain saw for measuring a length of wood to be cut and also for insuring that the wood is cut in the proper plane. The attachment includes a clamp consisting of a pair of mutually cooperating yoke assemblies fastened to each other by a pair of bolts. The clamp is affixed to the handle by which the saw is held for cutting. One of the yoke assemblies includes a short hollow cylinder for receiving one end of a cylindrical measuring arm. The inside of the cylinder and the diameter of the arm are roughly equivalent so that the arm fits snugly into the cylinder yet may be removed easily if desired. This may be accomplished without taking the clamp assembly off of the chain saw handle. An index pointer is slidably mounted on the arm by means of a coiled leaf spring which frictionally grips the arm. The coil leaf spring includes tynes which may be pinched together to relieve the pressure on the spring so that the pointer may be moved from one position to another along the length of the arm.

One of the tynes is insertable into one end of a helical spring. The other end of the helical spring receives a rod which extends forwardly of the arm and perpendicular to its axis. Since the rod is mounted in a helical spring it may flex in any direction. Thus, if the blade of the chain saw is lined up on the wood to be cut with the index pointer rod adjacent a sawn end of the log, a cut of the proper length and in the proper plane will be made as long as the pointer just grazes the face of the sawn log. If, however, the user observes that the index pointer is flexing in any direction this would be an indication that the cut is not being made in the proper plane or at the proper length and an adjustment is necessary.

The index pointer is also particularly useful when cutting along a length of wood where the index pointer marks a point on the interior of the log and a cut must be made a fixed distance from this point. In this instance the cut may be made with the index pointer attached to the arm because as the blade is driven through the wood the index pointer will simply flex in an upward direction while still marking the spot of reference on the interior of the log.

It is a primary object of this invention to provide an easily detachable length measuring attachment which may be retrofitted to any conventional chain saw.

A further object of this invention is to provide a length measuring attachment for a chain saw having a resiliently mounted length index pointer for marking distances along a length of wood to be cut.

Yet a further object of this invention is to provide a length measuring attachment for a chain saw which will enable the user to determine if the cut is being made in the proper plane as well as at the proper length along the piece of wood to be cut.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
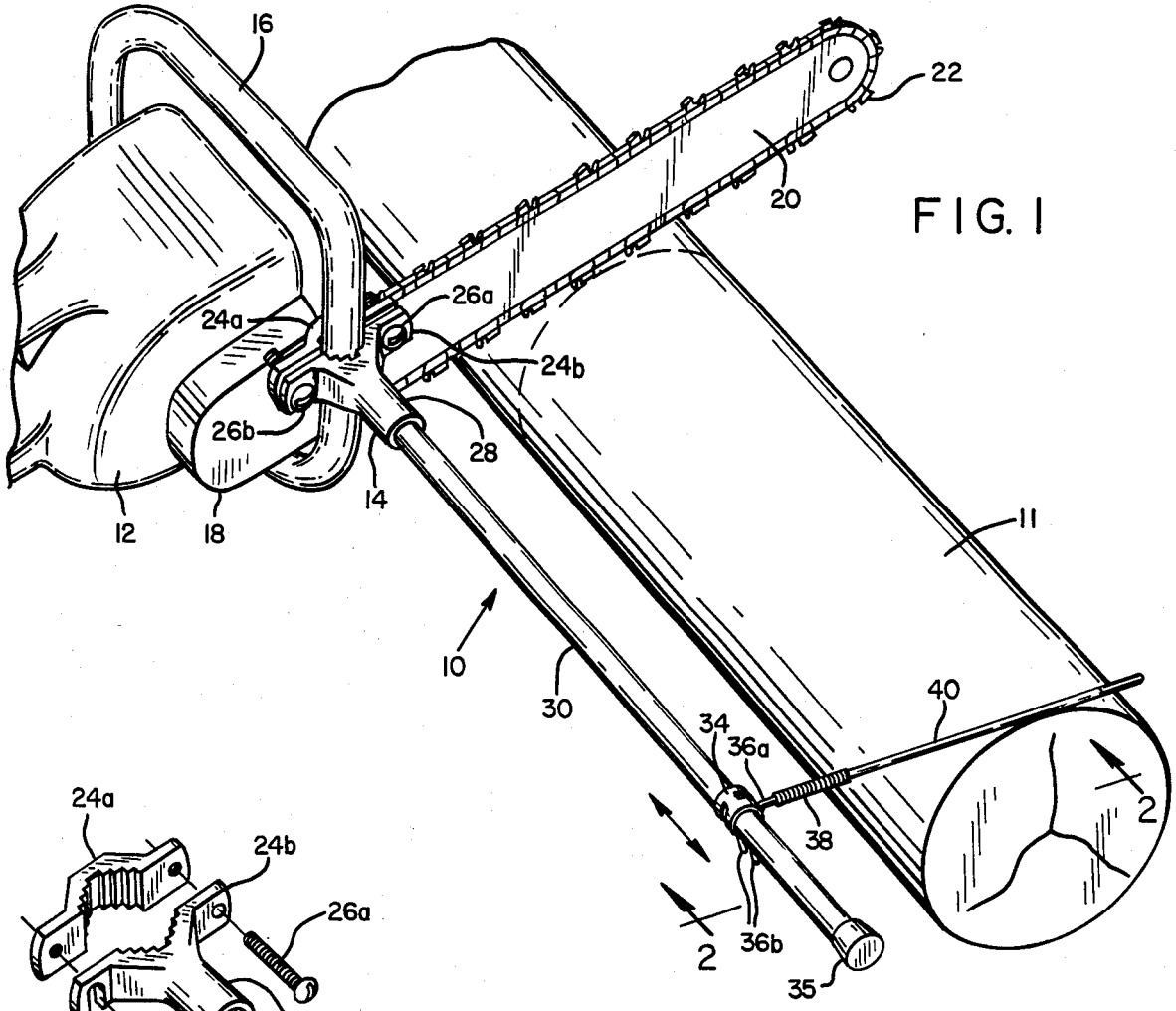
FIG. 1 is a perspective view of the length measuring attachment for a chain saw coupled to the handle of a conventional chain saw.
Figure 3:
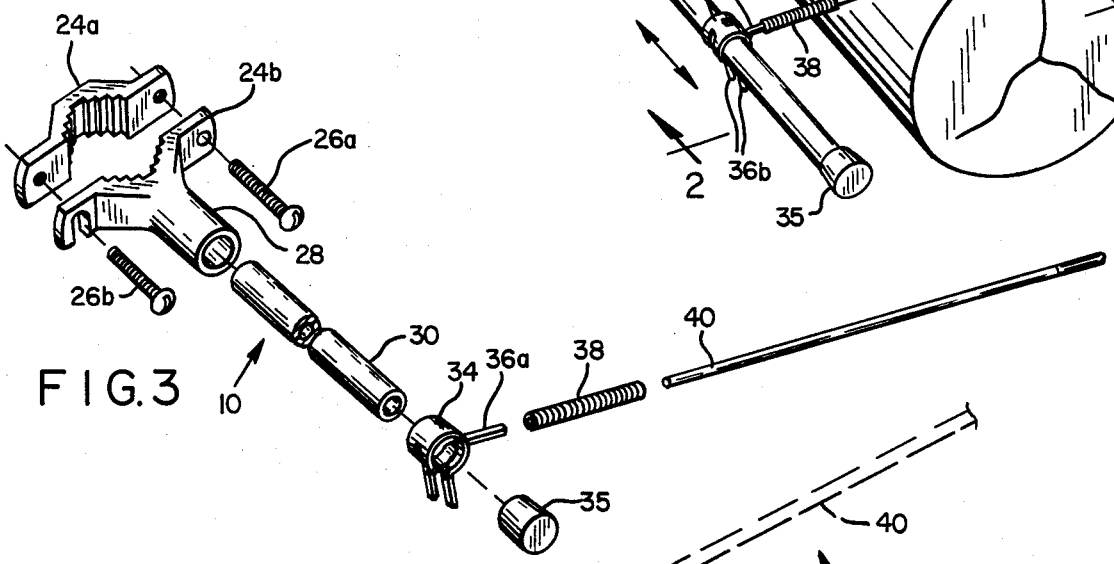
FIG. 3 is an exploded perspective view of the length measuring attachment shown in FIG. 1.

A length measuring attachment 10 for a chain saw 12 includes a detachable clamp assembly 14 which may be mounted to the handle 16 of the chain saw 12. The chain saw 12 includes a housing 18, a guide bar 20 and a cutting chain 22. The clamp assembly 14 includes a pair of yokes 24*a* and 24*b* coupled together by screws 26*a* and 26*b*. The yoke 24*b* includes a hollow cylindrical protrusion 28 which is dimensioned to receive a measuring arm 30. The arm 30 has a diameter which allows it to fit snugly inside the cylindrical protrusion 28 yet may be pulled out for ease of transport. This allows the clamp 14 to remain on the handle while allowing the arm to be placed elsewhere when carrying the chain saw 12 through the brush.

Figure 2:
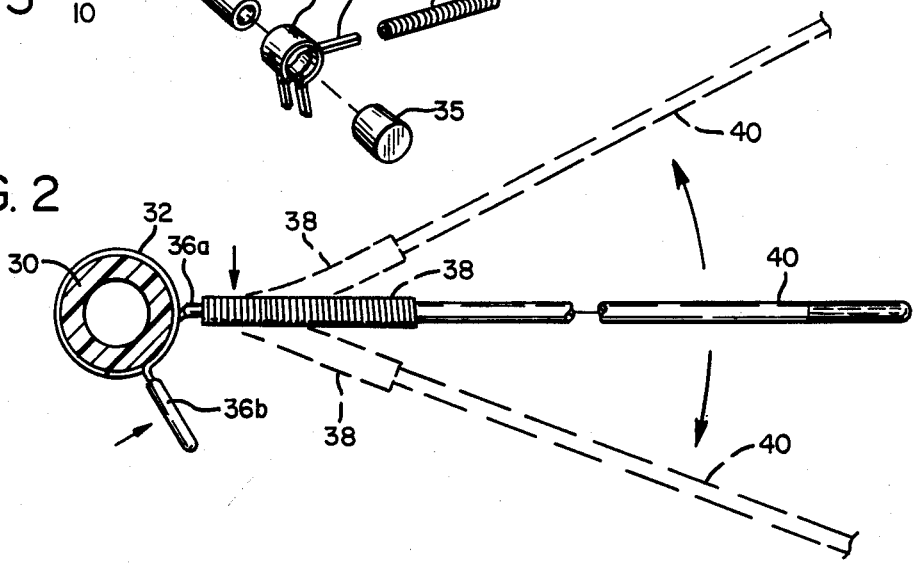
FIG. 2 is a cutaway side view taken along line 2—2 of FIG. 1 of the index pointer mounted on the arm of the attachment in FIG. 1.

An index pointer assembly 32 comprises a leaf spring 34 which slidably mounts to arm 30. The leaf spring includes tynes 36*a* and 36*b* which may be squeezed together in order to slide leaf spring 34 along arm 30. Tyne 36*a* is inserted into a helical spring 38 which resiliently mounts pointer rod 40 to the leaf spring 34 and hence to arm 30. The pointer 40 snugly engages one end of the helical spring 38 and the tyne 36*a* snugly engages the other end. As shown in FIG. 2, the index pointer assembly may be moved from point to point on arm 30 by simply squeezing the tynes 36*a* and 36*b* in the direction indicated by the arrows in FIG. 2 which will loosen the pressure from the leaf spring 34. If desired, it may be slid off the end of the arm 30 entirely by removing the end cap 11.

The rod 40 is resiliently mounted to the arm 30 by way of spring 38 so that if the pointer encounters any resistance it has freedom to flex in any direction. The dashed lines shown in FIG. 2 indicate the freedom of movement of the arm 40 in the plane of the drawing but it will be appreciated that the index pointer can also move from side to side. This may be a particularly useful feature where one is cutting a piece of wood from the sawn end of a log like log 11 in FIG. 1. As long as the index pointer arm 40 is lined along the face of log 11 the operator may be assured that the cut is being made in the proper plane and at the proper length, however, if the pointer were to be observed flexing either up or down or from side to side this would be an indication to the operator that the plane or position of the cut is incorrect.

Moreover, the up and down flexibility of the pointer 40 indicated in FIG. 2 enables one to use the length measuring attachment for cuts where the cut is to be made from a point on the interior of the log. In this case the arm 40 would be lined up with a point on the interior of a log and the cut made allowing the arm 40 to flex in an upward direction as the chain blade 22 passes through the wood.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A length measuring attachment for a chain saw comprising detachable clamp means for clamping the attachment to a stationary portion of the chain saw, an elongate support arm connected to the clamping means and extending to the side of the chain saw in a direction transverse to a longitudinal-oriented chain saw bar, and an index pointer detachably coupled to the support arm and slideably amounted thereon, whereby the index pointer may be set at any location along the transverse length of the arm for indicating the length of an article to be cut by the chain saw, wherein the index pointer includes a longitudinally extending rod resilently mounted to the elongate support arm, and wherein the longitudinally extending rod is frictionally held within one end of a helical spring having a longitudinally extending axis, and a frictional manually operated clamp is connected to the other end of the spring for engaging the elongate support arm.

2. The length measuring attachment of claim 1 wherein the frictional manually operated clamp includes a cylindrical leaf spring disposed about the arm, each end of the leaf spring including manually engageable tynes for releasing the tension on the leaf spring whereby the index pointer may be moved to various locations along the length of the arm.

3. The length measuring attachment of claim 2 wherein one of the tynes is insertable into the other end of the helical spring.

* * * * *

UNITED STATES PATENT AND TRADEMARK OFFICE

CERTIFICATE OF CORRECTION

PATENT NO. : 4,625,407

DATED : December 2, 1986

INVENTOR(S) : F. Patrick Wallis

It is certified that error appears in the above-identified patent and that said Letters Patent is hereby corrected as shown below:

| | |
|---|---|
| Col. 4, line 33 | Change "longitudinal-oriented" to --longitudinally-oriented-- |
| Col. 4, line 35 | Change "slideably amounted" to --slidably mounted-- |
| Col. 4, line 39 | Change "resilently" to --resiliently-- |

Signed and Sealed this

Twenty-seventh Day of February, 1990

*Attest:*

JEFFREY M. SAMUELS

*Attesting Officer* *Acting Commissioner of Patents and Trademarks*